US007275344B2

(12) United States Patent
Woodmansee, III et al.

(10) Patent No.: US 7,275,344 B2
(45) **Date of Patent: *Oct. 2, 2007**

(54) MOUNTING ASSEMBLY AND METHODS OF USING SAME

(75) Inventors: John W. Woodmansee, III, Plano, TX (US); Donald W. Wooten, Dallas, TX (US)

(73) Assignee: Tactical and Rescue Gear, Ltd., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/545,408

(22) Filed: Oct. 10, 2006

(65) Prior Publication Data

US 2007/0028502 A1 Feb. 8, 2007

Related U.S. Application Data

(63) Continuation of application No. 10/859,333, filed on Jun. 2, 2004, now Pat. No. 7,117,627.

(51) Int. Cl.
*F41G 1/34* (2006.01)
*F41G 1/35* (2006.01)

(52) U.S. Cl. ..... 42/146; 42/114; 362/110

(58) Field of Classification Search ..... 42/146, 42/114, 124, 127; 362/110, 112; D8/395, D8/396; D22/108–110
See application file for complete search history.

(56) References Cited

U.S. PATENT DOCUMENTS

| | | | | |
|---|---|---|---|---|
| 1,107,040 | A * | 8/1914 | Conde | 362/110 |
| 4,418,487 | A * | 12/1983 | Strahan | 42/125 |
| 4,542,447 | A * | 9/1985 | Quakenbush | 362/183 |
| 5,040,322 | A * | 8/1991 | Iturrey, Jr. | 42/146 |
| 5,107,612 | A * | 4/1992 | Bechtel | 42/115 |
| 5,430,967 | A * | 7/1995 | Woodman et al. | 42/114 |
| 5,758,448 | A * | 6/1998 | Thummel | 42/114 |
| 6,115,952 | A * | 9/2000 | Rigler | 42/146 |
| 6,185,854 | B1 * | 2/2001 | Solinsky et al. | 42/111 |
| 6,385,893 | B1 * | 5/2002 | Cheng | 42/124 |
| 6,393,752 | B1 * | 5/2002 | Oliver et al. | 42/114 |
| 6,574,901 | B1 * | 6/2003 | Solinsky et al. | 42/146 |

* cited by examiner

*Primary Examiner*—Michael J. Carone
*Assistant Examiner*—Bret Hayes
(74) *Attorney, Agent, or Firm*—Dunlap Codding & Rogers

(57) ABSTRACT

The mounting assembly for securing an accessory to a firearm. The accessory has a body with an undercarriage portion which is shaped to matingly receive at least a portion of the undercarriage of the firearm, a trigger guard portion shaped to engage at least a portion of the trigger guard firearm and a firearm connector portion which is constructed of a resilient deformable material which forms a snap-fit with a portion of the firearm in order to secure the body to the firearm. The body also has an accessory connector portion shaped to secure an accessory to the body.

10 Claims, 3 Drawing Sheets

MOUNTING ASSEMBLY AND METHODS OF USING SAME

CROSS REFERENCE TO RELATED APPLICATIONS

The present application is a continuation of U.S. Ser. No. 10/859,333, filed Jun. 2, 2004, now U.S. Pat. No. 7,117,627 B2, which is incorporated herein by reference in its entirety.

BACKGROUND OF THE INVENTION

The police, military and even sportsman frequently find it necessary to mount an accessory such as a flashlight, laser pointer, grenade launcher or even an aerosol can to their firearm in order to better see and hit their intended target. The accessory may only be needed in special circumstances such as during the nighttime and there are also numerous disadvantages to permanently mounting such accessory to the firearm. For instance, the accessory can interfere with the placement and removal of the firearm from a policeman's holster. However, when the need arises to mount the accessory to the firearm, it may be imperative that the police officer, soldier or sportsman be able to quickly and conveniently secure the accessory to the firearm without the burden of disassembling the firearm or using any tools. Therefore, a need exists for an apparatus that enables a user to quickly and efficiently secure an accessory to a firearm without having to disassemble the firearm or use any tools. It is to such a need that the present invention is directed.

SUMMARY OF THE INVENTION

In general, the present invention relates to a mounting assembly for securing an accessory to a firearm. The firearm has an undercarriage and a trigger guard. In one preferred embodiment, the firearm is a semi automatic pistol, such as a Berretta model no. 92, Sig model no. 226, or Colt model no. 1911. In general, the mounting assembly is provided with a body having an undercarriage portion, a trigger guard portion, a firearm connector portion, and an accessory connector portion. The under carriage portion is shaped to matingly receive at least a portion of the undercarriage of the firearm. The trigger guard portion is shaped to engage at least a portion of the trigger guard of the firearm. The firearm connector portion is constructed of a resilient, deformable material such as plastic that enables a snap-fit with a portion of the firearm in order to secure the body to the firearm. In one preferred embodiment, the firearm connector portion is provided with an opening that receives a pin extending from the firearm. The pin can be characterized as a slide stop pin. The accessory connector portion of the mounting assembly permits the accessory to be connected to the body. The accessory can be any type of accessory which can be secured to the firearm. For example, but not limitation, the accessory can be a flashlight, or a laser sighting device.

One skilled in the art will recognize many advantages of the mounting assembly constructed in accordance with the present invention. For example, the snap-fit of the firearm connector portion permits the mounting assembly to be quickly attachable to the firearm without having to use separate tools, and/or other types of devices. Preferably, the fit is such that an aiming laser, adjusted to point accurately at the actual strike of the bullet when fired, remains substantially accurate if the mounting assembly is taken off the weapon and put back on the weapon.

BRIEF DESCRIPTION OF THE SEVERAL VIEWS THE DRAWING

DETAILED DESCRIPTION OF THE INVENTION

Figure 1:
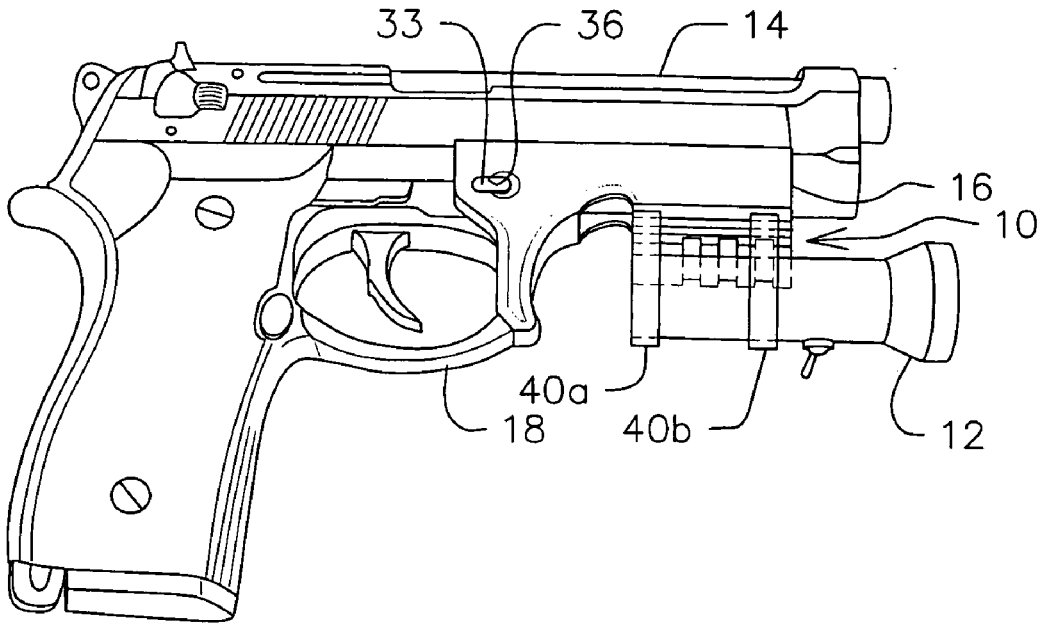
FIG. 1 is a side elevational view of a mounting assembly constructed in accordance with the present invention for securing an accessory to a firearm wherein the mounting assembly is shown connected to the fire arm and with the accessory connected to the mounting assembly.

Referring now to the drawings, and in particular to FIG. 1, shown therein and designated by a reference numeral 10 is a mounting assembly for securing an accessory 12 to a firearm 14. The firearm 14 is provided with an undercarriage 16, and a trigger guard 18. The accessory 12 can be any type of device capable of being attached to the firearm 14 utilizing the mounting assembly 10. For example, the accessory 12 can be a flashlight, a laser sighting device, a grenade launcher, or the like. The firearm 14 is typically a semi-automatic pistol, although in certain embodiments the firearm 14 may be a rifle, a shotgun, a revolver, a BB gun, a pellet gun, a paintball gun or even a toy gun.

The mounting assembly 10 is provided with a body 24. The body 24 is provided with an undercarriage portion 26, a trigger guard portion 28, a firearm connector portion 30, and an accessory connector portion 32. The undercarriage portion 26 is shaped to matingly receive at least a portion of the undercarriage 16 of the firearm 14. The trigger guard portion 28 is shaped to engage at least a portion of the trigger guard 18 of the firearm 14. The firearm connector portion 30 is constructed of resilient, deformable material, such as a polymeric or metallic material for forming a snap-fit with a connection surface 33 of the firearm 14 in order to secure the body 24 to the firearm 14. The accessory connector portion 32 is shaped to permit the accessory 12 to be secured to the body 24. It should be noted that in the embodiment depicted in FIG. 1, the body 24 is shown with the under carriage portion 26, the trigger guard portion 28, the firearm connector portion 30, and the accessory connector portion 32 being formed together to provide a unitary structure. However, it should be understood that in certain instances it may be desirable to form one or more of the undercarriage portion 26, the trigger guard portion 28, the firearm connector portion 30, or the accessory connector portion 32 separately and to connect such portions together. Such portions can be connected in any suitable manner, such as welding, epoxy, adhesive, one or more fasteners, or the like. In one preferred embodiment, the body 24 is constructed of metal, plastic, or polymeric material. The body 24 can be formed from any suitable process, such as casting, injection molding, vacuum molding, milling, thermoforming, or the like. It should be understood that the construction of devices utilizing material such as metal or plastic with these processes is well known in the art. Thus, no further comments regarding the operation of these processes is deemed necessary to teach one skilled in the art how to make and/or use the mounting assembly 10.

Figure 2:
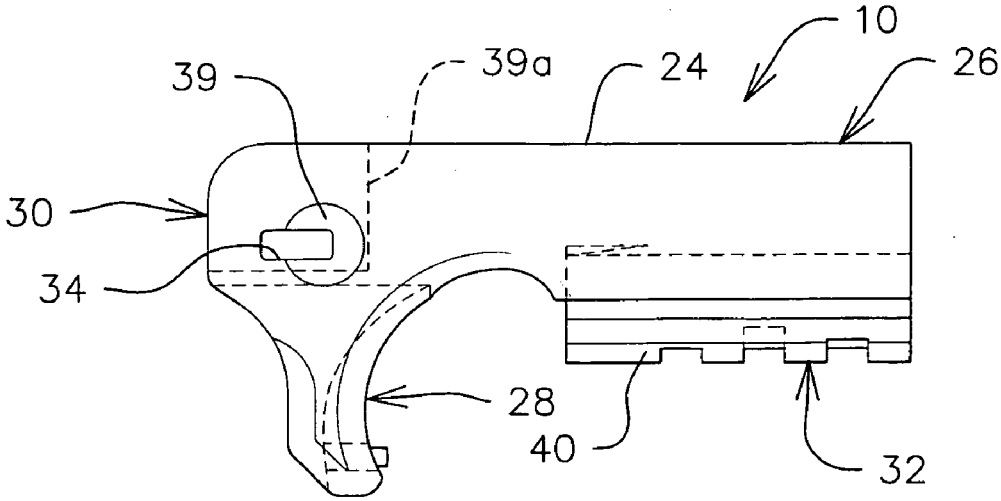
FIG. 2 is a side elevational view of the mounting assembly depicted in FIG. 1.

Referring now to FIG. 2 shown therein is the mounting assembly 10 unattached from the firearm 14. The firearm connector portion 30 includes an opening 34 that is sized and shaped to receive the connection surface 33. In particular, the connection surface 33 is formed about a pin 36 (FIG. 1) which protrudes from the firearm 14. In use, the pin 36 and the opening 34 do not flex. The structure around the opening 34 flexes and the firearm connector portion 30 flexes around the pin 36 such that the pin is disposed in the opening and forms a snap-fit to secure the body 24 to the firearm 14. The pin 36 can be, for instance, a slide stop pin (FIG. 1) which has been adapted in accordance with the present invention to protrude approximately 1/32 of an inch to 1/16 of an inch from the firearm 14. It should also be noted that the firearm connector portion 26 can include a recessed area 39 surrounding the opening 34 to receive a user's finger to facilitate removal of the firearm connector portion 30 from the connection surface 33 of the firearm 14 to remove the mounting assembly 10 from the firearm 14. An inner surface of the firearm connector portion 30 is relieved to form a tapered or ramp structure 39*a* (as shown by way of the dashed lines) to facilitate the positioning of the firearm connector portion 30 onto the connection surface 33.

The accessory connector portion 32 of the body 24 is shown as including at least one rail 40 designed to permit the accessory 12 (FIG. 1) to be mounted thereto. Typically, rails 40*a* and 40*b* will be used to secure the accessory 12 to the body 24. It should be noted that the rail 40 can be a type of rail commonly referred to as the U.S. Army's Picatinny rail or the commercial Weaver rail.

Figure 3:
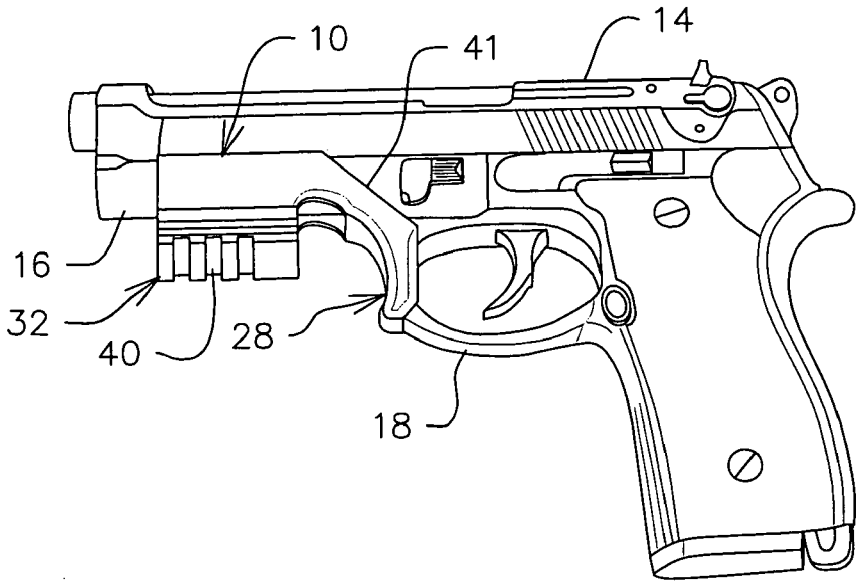
FIG. 3 is a side elevational view of the mounting assembly, generally opposite that shown in FIG. 3.

Referring now to FIG. 3 shown therein is the mounting assembly 10 without the accessory 12 attached thereto. It should be noted that the firearm connector portion 30 can include an angled portion 41 which provides clearance for access and operation of the slide stop pin.

Figure 4:
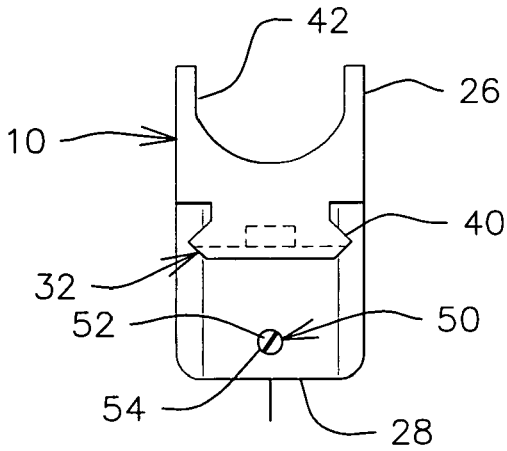
FIG. 4 is a front elevational view of the mounting assembly.

Referring now to FIG. 4 the undercarriage portion 26 defines a first channel 42 adapted to substantially conform with the undercarriage 16 of the firearm 14. In one preferred embodiment, the first channel 42 has a substantially U-shape configuration such that the first channel 42 substantially conforms to at least a portion of the undercarriage 16 of the firearm 14. This substantially U-shaped configuration helps to align the mounting assembly 10 with the undercarriage 16 of the firearm 14 and also helps to frictionally secure the body 24 to the firearm 14. It should be noted that although the undercarriage portion 26 is shown and described as having a "first channel", those skilled in the art will readily recognize and appreciate that the undercarriage portion 26 can be of any configuration as long as the undercarriage portion 26 at least partially conforms to the undercarriage 16 of the firearm 14.

Figure 5:
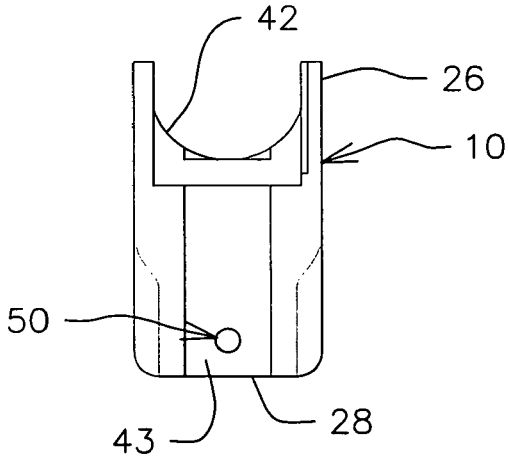
FIG. 5 is a rear elevational view of the mounting assembly generally opposite that shown in FIG. 4.

Referring now to FIG. 5 the trigger guard portion 28 defines a second channel 43 adapted to substantially conform to the shape of the trigger guard portion 28. In one preferred embodiment, the second channel 43 has a substantially U-shaped cross-section that extends arcuately along the longitudinal axis of the second channel 43 such that the second channel 43 substantially conforms to at least a portion of the trigger guard 18 of the firearm 14.

Also shown in FIGS. 4 and 5 is a fastener 50 for engaging the trigger guard portion 18 of the firearm and providing an adjustment between the trigger guard 18 and the body 10. In this embodiment of the invention, the fastener 50 is shown and described as a screw 52 and a threaded hole 54 formed in the body 24 for receiving the screw 52. The screw 52 can be threaded through the threaded hole 54 to put pressure on the trigger guard and enhanced attachment of the body 24 to the firearm 14.

Figure 6:
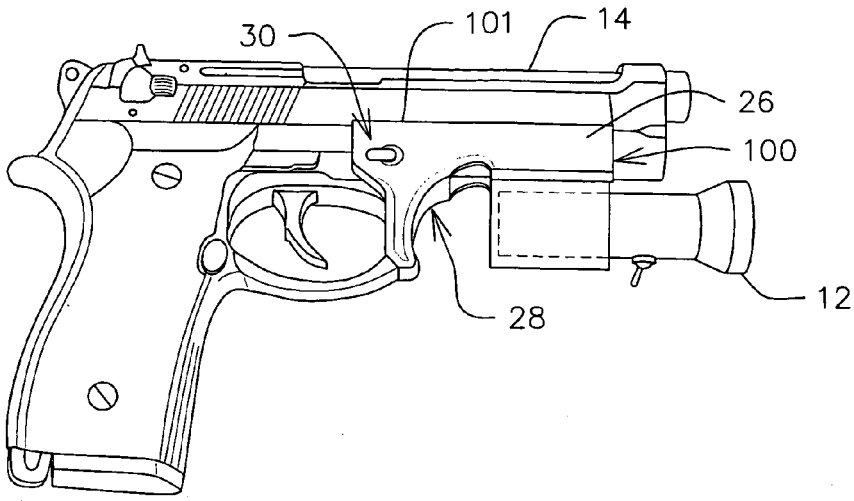
FIG. 6 is a side elevational view of an alternate embodiment of a mounting assembly constructed in accordance with the present invention, wherein an accessory is mounted within the body.

Referring now to FIG. 6 shown therein and designated by the reference 100 is an alternate embodiment of a mounting assembly for securing the accessory 12 to the firearm 14. The mounting assembly 100 is similar to the mounting assembly 10, in that, the mounting assembly 100 includes a body 101 having the undercarriage portion 26, the trigger guard portion 28 and the firearm connector portion 30. However, in this embodiment of the invention, the accessory connector portion 30 is designed to integrate the accessory 12 into the body 101 of the mounting assembly 100.

Figure 7:
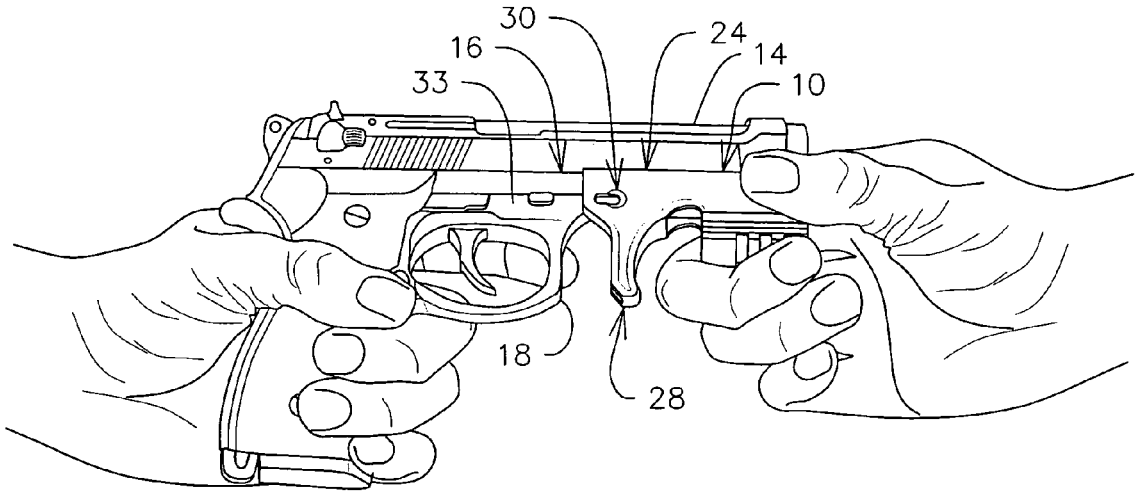
FIG. 7 is a depiction of a user securing the mounting assembly to the firearm.

Referring now to FIG. 7, in order to secure the mounting assembly 10 or 100 to the firearm, typically a user will hold the firearm 14 in one hand and the mounting assembly 10 or 100 in the other hand. The user then aligns the undercarriage portion 26 of the body 24 or 101 of the mounting assembly 10 or 100 with the undercarriage 16 of the firearm 14. At the same time, the user also aligns the trigger guard portion 28 of the body 24 or 101 of the mounting assembly 10 or 100 with the trigger guard 18 of the firearm 14 and the firearm connector portion 30 is disposed in close proximity to the connection surface 33 of the firearm 14. The user then presses the body 24 against the firearm 14 such that the firearm connector portion 30 of the body 24 slightly deforms and forms a snap-fit with the connection surface 33 of the firearm 14 and the trigger guard portion 18 and the undercarriage portion 26 are frictionally secured to the trigger guard 18 and undercarriage 16 of the firearm 14, respectively. Thereafter, the fastener 50 can be utilized to remove any slack or stop between the body 24 or 101 and the firearm 14. The user can then attach the accessory 12 to the body 24 via the accessory connector portion 32 of the body 24. It should be noted that the accessory 12 can be connected to the accessory connector portion 32 of the body 24 prior to or after snap-fitting the body 24 to the firearm 14.

The body 24 can be disconnected from the firearm 14 by grasping the body 24 in one hand and the firearm 14 in the other hand and lifting the firearm connector portion 30 with a fingernail or screwdriver while applying opposing forces of sufficient magnitude to deform the deformable material of the firearm connector portion 30 sufficiently to remove the body 24 from the firearm.

Although the connection surface 33 has been described herein as the pin 36, it should be understood that the connection surface 33 can be formed in other manners. For example, the connection surface 33 can be formed about a recess or dimple provided in the firearm 14.

The mounting assembly 10 or 100 can also be sold or provided as a kit for securing an accessory to the firearm 14. The kit can include the body 24 and an extended pin for retrofitting the firearm 14. The extended pin and the body 24 can be included in the same packaging. The extended pin permits the firearm 14 to be adapted such that a portion of the extended pin protrudes from the firearm 14 a sufficiently distance to allow the portion of the extended pin to be disposed in the opening 34 of the firearm connection portion 30 of the body 10. The method of removal and replacement of a pin such as a slide stop pin in a firearm is well known to those skilled in the art and need not be further described herein. It should be noted that the kit may also include the accessory 12.

Changes may be made in the construction and operation of the various component elements and assemblies described herein on the step and sequences and steps of the method described herein without departing from the spirit and scope of the invention as defined in the following claims.

What is claimed is:

1. A mounting assembly for securing an accessory to a firearm having an undercarriage, a trigger guard and a pin, the mounting assembly comprising:

a body having an undercarriage portion, a trigger guard portion, a firearm connector portion, and an accessory connector portion, the undercarriage portion having a channel shaped to matingly receive at least a portion of the undercarriage of the firearm, the firearm connector portion having an opening sized and shaped to receive the pin, the firearm connector portion being resilient such that the firearm connector portion is deflectable, outwardly over the pin of the firearm to insert the pin in the opening thereby securing the body to the firearm.

2. The mounting assembly of claim 1 wherein the accessory connector portion includes at least one rail extending longitudinally along the length thereof for securing an accessory to the body.

3. The mounting assembly of claim 1 wherein the pin is characterized as a slide stop pin.

4. The mounting assembly of claim 1 wherein the accessory connector portion integrates the accessory into the body.

5. The mounting assembly of claim 1 further comprising at least one fastener engaging the trigger guard portion to provide an adjustment between the trigger guard of the firearm and the body.

6. A kit for retrofitting a firearm for removably securing an accessory to the firearm, the firearm having an undercarriage and a trigger guard, the kit comprising:

a pin positionable within the firearm and adapted to extend from the firearm wherein the pin is installed within the firearm; and a body having an undercarriage portion, a trigger guard portion, a firearm connector portion, and an accessory connector portion, the undercarriage portion having a first shaped to receive at least a portion of an undercarriage of the firearm, the firearm connector portion having an opening sized and shaped to receive the pin extending from the firearm when the pin is installed in the firearm accessory connector portion, the firearm connector portion being resilient such that the firearm connector portion is deflectable outwardly over the pin to insert the pin in the opening thereby securing the body to the firearm.

7. The kit of claim 6 wherein the accessory is a laser pointer.

8. A mounting assembly for a firearm having a mounting pin, the mounting assembly comprising:

a body having an undercarriage portion, a trigger guard portion, a firearm connector portion, and an accessory connector portion, the undercarriage portion having a channel shaped to matingly receive at least a portion of the undercarriage of the firearm, the firearm connector portion having an opening sized and shaped to receive the pin, the firearm connector portion being resilient such that the firearm connector portion is deflectable outwardly over the pin of the firearm to insert the pin in the opening thereby securing the body to the firearm; and an accessory detachably connected to the accessory connector portion of the body.

9. The mounting assembly of claim 8 wherein the accessory connector portion includes at least one rail extending longitudinally along the length thereof for securing the accessory to the body.

10. The mounting assembly of claim 9 wherein the accessory connector portion includes at least one recess traversing the width thereof for matingly receiving at least a portion of the accessory.

* * * * *